United States Patent [19]

King et al.

[11] 3,948,759

[45] Apr. 6, 1976

[54] VISBREAKING A HEAVY HYDROCARBON FEEDSTOCK IN A REGENERABLE MOLTEN MEDIUM IN THE PRESENCE OF HYDROGEN

[75] Inventors: Laurence F. King, Mooretown; Noel J. Gaspar; Israel S. Pasternak, both of Sarnia, all of Canada

[73] Assignee: Exxon Research and Engineering Company, Linden, N.J.

[22] Filed: Feb. 27, 1975

[21] Appl. No.: 553,492

Related U.S. Application Data

[63] Continuation-in-part of Ser. No. 345,540, March 28, 1973, Pat. No. 3,871,992.

[52] U.S. Cl. ..... 208/106; 48/197 R; 208/48 Q; 208/52 R; 208/52 CT; 208/107; 208/108; 208/112; 208/114; 208/125; 208/251 H; 208/292; 208/298; 208/131; 208/209; 208/235; 208/248; 208/288; 252/411 A; 252/416; 252/420; 252/432; 252/477 R; 260/683 R

[51] Int. Cl.[2] C10G 13/06; B01J 35/12; B01J 21/02; B01J 23/04

[58] Field of Search ..... 208/107, 106, 108, 112, 208/114, 125, 131, 251 H, 288, 292, 298; 260/683 R

[56] References Cited

UNITED STATES PATENTS

| | | | |
|---|---|---|---|
| 3,387,941 | 6/1968 | Murphy et al. | 208/235 |
| 3,440,164 | 4/1969 | Aldridge et al. | 208/235 X |
| 3,553,279 | 1/1971 | Bawa | 260/683 R |
| 3,745,109 | 7/1973 | Heredy et al. | 208/107 |
| 3,803,023 | 4/1974 | Hamner | 208/131 X |
| 3,816,298 | 6/1974 | Aldridge | 208/112 |
| 3,835,033 | 9/1974 | Dugan et al. | 208/125 |
| 3,836,452 | 9/1974 | Gleim | 208/292 X |
| 3,847,797 | 11/1974 | Pasternak et al. | 208/114 |
| 3,862,025 | 1/1975 | Steele et al. | 208/109 |

*Primary Examiner*—Delbert E. Gantz
*Assistant Examiner*—Geo. E. Schmitkons
*Attorney, Agent, or Firm*—John W. Ditsler

[57] ABSTRACT

Heavy hydrocarbon feedstocks, such as atmospheric and vacuum residua, heavy crude oils and the like, are converted to predominantly liquid hydrocarbon products by contacting said feedstocks in the presence of hydrogen with a regenerable alkali metal carbonate molten medium containing a glass-forming oxide, such as boron oxide, at a temperature in the range of from above about the melting point of said molten medium to about 1000°F. and at elevated pressures. Preferably, the regenerable molten medium comprises an oxide of boron in combination with a mixture of sodium and lithium carbonate or a mixture of sodium carbonate, potassium carbonate and lithium carbonate. The carbonaceous materials (coke) which are formed in the molten medium during the above-described conversion process are gasified by contacting said carbonaceous materials with a gaseous stream containing oxygen, steam, or carbon dioxide at temperatures of from above about the melting point of said medium to about 2000°F. in order to gasify said carbonaceous materials and thereby regenerate the molten medium. The conversion of a heavy hydrocarbon feedstock by the above-described process reduces the viscosity of the feedstock and thereby produces increased proportions of predominantly liquid hydrocarbon products of the motor fuel range, fuel oils and lubricant basestocks.

26 Claims, 1 Drawing Figure

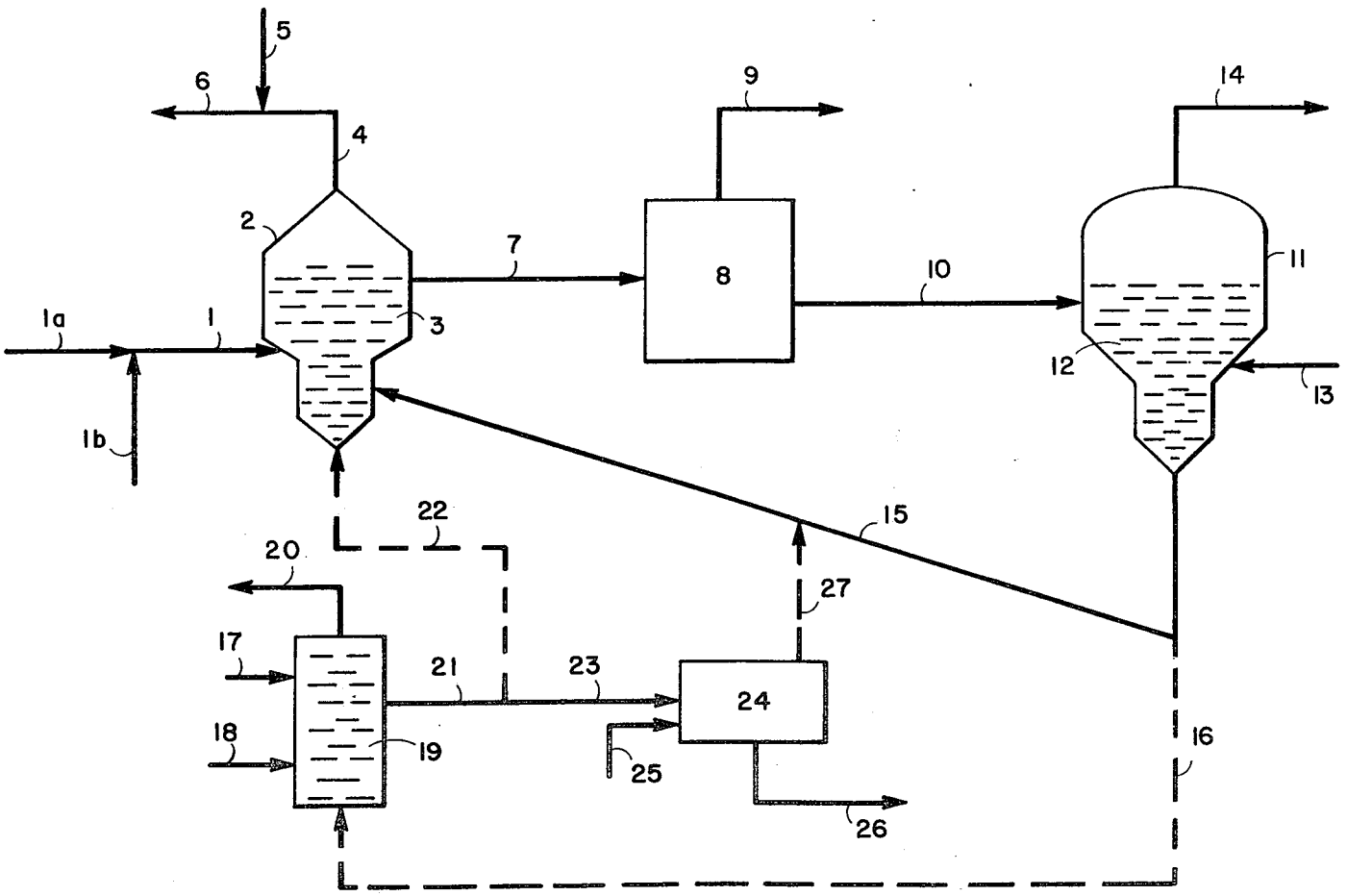
1a
1b
1
2
3
4
5
6
7
8
9
10
11
12
13
14
15
16
17
18
19
20
21
22
23
24
25
26
27

VISBREAKING A HEAVY HYDROCARBON FEEDSTOCK IN A REGENERABLE MOLTEN MEDIUM IN THE PRESENCE OF HYDROGEN

CROSS-REFERENCE TO RELATED CASES

This is a continuation-in-part of application Ser. No. 345,540, filed Mar. 28, 1973, now U.S. Pat. No. 3,871,992.

BACKGROUND OF THE INVENTION

1. Field of the Invention

This invention relates to the conversion of heavy hydrocarbon feedstocks to produce increased proportions of motor fuel range hydrocarbons and fuel oils. More particularly, this invention relates to converting a heavy hydrocarbon feedstock to liquid hydrocarbon products by contacting said feedstock with an alkali metal carbonate molten medium and hydrogen. Still more particularly, this invention relates to the conversion of a heavy hydrocarbon feedstock such as atmospheric and vacuum residua, crude oils and the like, at elevated pressures and in the presence of hydrogen in a regenerable molten medium containing boron oxide and an alkali metal carbonate to produce predominantly liquid hydrocarbon products such as a gas oil and carbonaceout materials. At least a portion of the carbonaceous materials formed during the cracking process are gasified by contacting said carbonaceous materials in the molten medium with air, steam or carbon dioxide at elevated temperatures in order to regenerate the melt.

2. Description of the Prior Art

Heavy hydrocarbon materials such as atmospheric or vacuum residua, crude oil and the like, are typically subjected to a viscosity-reducing or "visbreaking" treatment at high temperatures and elevated pressures to convert, by a mild thermal cracking, the feedstock to about 5 to 15% gas oil, about 5 to 15 volume % gasoline, and about 75 to 85% heavy fuel oil. The specific temperatures, pressures, and feed rates employed in the visbreaking process depend upon the type of visbreaker feed. The gas oil formed by such a process represents a feedstock suitable for the production of additional amounts of high quality gasoline by catalytic cracking or, after suitable finishing, such as sulfur and/or nitrogen removal, an acceptable distillate fuel or lube oil fraction.

The conversion of heavy hydrocarbon feedstocks, such as residua, is relatively difficult in view of their tendency to form coke when subjected to moderately high temperatures. This coke-forming tendency has also limited the industrial application of molten heat transfer media in order to effect the hydrocarbon conversion of such feedstocks. The primary difficulty encountered when employing molten media systems for such conversion processes is that the carbonaceous particles, i.e., coke, produced during the conversion operation are not suspended in the melt, but form a separate phase which contaminate the liquid and gaseous products. With melts that partially suspended the coke, such as alkali metal halide eutectics, e.g., lithium-potassium chloride, the buildup of such carbonaceous materials in or above the molten medium necessitates additional steps to physically remove the carbonaceous particles from the melt.

It has been suggested that hydrocarbon feedstocks can be cracked in molten alkali metal carbonate, alkali metal hydroxide, or a mixture thereof, to form various hydrocarbon products and the molten medium thereafter regenerated by contacting the same with oxygen or steam (see U.S. Pat. Nos. 3,553,279; 3,252,774; German DT-OS 2,149,291; U.S. Pat. Nos. 3,505,018; 3,252,773; 3,438,727; 3,647,358; 3,438,728; Oil and Gas Journal, Sept. 27, 1971; U.S. Pat. Nos. 3,438,733; 3,434,734; 3,516,796; 3,551,108 and 3,647,358. Further, in Czechoslovakian Patent 109,952 it is disclosed that various compositions can be employed in the thermal cracking of hydrocarbons. While alkali metal carbonate based melts tend to absorb or disperse the coke formed in the conversion operation, the extent of coke dispersion is relatively low. This limited coke dispersion in the molten medium may cause process difficulties in a commercial environment.

Recently, it has been proposed to crack a hydrocarbon feedstock in a regenerable molten medium containing an alkali oxide in combination with a glass-forming oxide such as an oxide of boron (see U.S. Pat. No. 3,850,742). Such a molten medium, while exhibiting sufficient coke dispersion, suffers from the disadvantage of being corrosive in nature, thereby resulting in a significant materials of construction problem.

SUMMARY OF THE INVENTION

It has now been discovered that heavy hydrocarbon feedstocks, particularly sulfur contaminated feedstocks, are converted to predominantlty liquid hydrocarbon products by contacting said feedstocks in the presence of hydrogen with an alkali metal carbonate molten medium that contains minor quantities of a specific glass-forming oxide coke dispersion aid at a temperature in the range of from above about the melting point of said medium to about 1000° F. and at elevated pressures for a period of time sufficient to form said liquid products. Thereafter, the carbonaceous materials formed and suspended in the molten medium during the conversion operation are contacted with a gasifying reagent such as a gaseous stream containing elemental or combined oxygen, e.g., air, carbon dioxide, steam, and mixtures thereof, at a temperature in the range from about the melting point of said medium to about 2000° F. for a period of time sufficient to regenerate the molten medium.

BRIEF DESCRIPTION OF THE DRAWING

The figure shows a flow plan of an integrated cracking/gasification process unit for cracking hydrocarbon feedstocks to predominantly liquid products.

DETAILED DESCRIPTION OF THE INVENTION

The regenerable molten medium of the instant invention comprises a glass-forming oxide (or oxide precursor), by which is meant an oxide of silicon, boron, phosphorus, molybdenum, tungsten, vanadium, and mixtures thereof. An oxide of boron is the most preferred glass-forming material.

The glass-forming oxides are employed in combination with an alkali metal (Group IA) carbonate, that is, a carbonate of lithium, potassium, sodium, rubidium, cesium or mixtures thereof. The molten medium may additionally contain other Group IA or IIA constituents such as the oxides, hydroxides, sulfides, sulfates or sulfites of sodium, lithium, potassium, cesium, rubidium, magnesium, calcium, strontium and barium. Alkali metal sulfides, sulfites and sulfates are formed in situ during the course of the conversion and/or subsequent gasification reactions by the reaction of sulfur contaminants of the feedstock with the alkali metal constituents of the melt. Alkali metal oxides are also generated in situ by reaction of carbon with alkali metal carbonates. Alkali metal hydroxides may be formed if water is present in the conversion of gasification zones. The concentration of the glass-forming oxide in the total molten medium is maintained between about 0.1 to 25 wt. % preferably 1 to 20 wt. %, most preferably 1 to 12 wt. %, calculated as the oxide thereof, e.g., $B_2O_3$, $V_2O_5$, $MoO_3$, $WO_3$, $SiO_2$ and $P_2O_5$, and based on total molten medium. It should be recognized that the glassforming oxide element, e.g., boron, may exist in various valence states at various points in the process. Accordingly, the expression "oxide of boron", etc. is intended to encompass any oxide of the applicable element.

The advantage of converting a heavy, metals (Ni, V, Fe), nitrogen, coke precursor and sulfur contaminated hydrocarbon feedstock in the above-mentioned molten medium, in addition to providing the heat transfer medium for the conversion of the heavy hydrocarbon feedstock to the predominantly liquid hydrocarbon products, lies in the ability of said medium to: (a) suspend the carbonaceous materials formed in situ during the conversion operation uniformly throughout the melt, (b) abstract the above-mentioned contaminants from the hydrocarbon materials being treated, and (c) thereafter, upon contact with a gasifying reagent at elevated temperatures to promote the rapid gasification of said carbonaceous materials. Accordingly, the instant invention attains a higher conversion of the heavy hydrocarbon feedstocks to predominantly liquid hydrocarbons than that which is obtainable with more conventional methods such as visbreaking. This is believed to be due in part to the molten melt promoting the cracking of the heavy hydrocarbon feedstocks. In addition, the presence of hydrogen serves, at least in part, to saturate at least a portion of the unsaturated materials, e.g. olefins, diolefins and aromatics, formed during the cracking reaction as well as to suppress polymerization reactions which form coke. Further, operation of the system at elevated pressures and relatively low temperatures favors an increase in liquid product yield. Accordingly the molten medium of the instant invention, when operated at the conditions specified herein, allows one to conduct such conversion processes at relatively low temperatures, thereby obtaining higher conversions to the predominantly liquid products since the formation of carbonaceous materials during said conversion process is minimized, said carbonaceous materials thus formed being gasified by contact with a gasifying reagent, as hereinafter defined.

In addition to promoting the gasification rate of the carbonaceous materials formed during the conversion process, the molten medium of the instant invention offers the additional advantages of significantly lowering the emission of pollutants into the atmosphere by absorbing or reacting with at least a portion, preferably a major portion, of the sulfur and/or sulfur compounds produced during the actual cracking or conversion operation and/or during the combustion or carbonaceous material during the gasification phase of the process, said sulfur impurities being retained by the molten medium. The liquid hydrocarbon products formed with the conversion process of the instant invention contain a significantly reduced amount of heavy metals, nitrogen and sulfur compounds and coke precursors compared to that originally contained in the heavy hydrocarbon feed. Furthermore, the molten medium of the instant invention possesses good thermal conductivity to allow efficient heat transfer.

Still another advantage exhibited by the molten medium of the instant invention is being noncorrosive in nature, particularly when compared with a molten medium containing a predominant amount of a glass-forming oxide. Accordingly, maintaining the concentration of the glass-forming oxide below about 25 weight percent, preferably below about 20 wt. percent, and more preferably below 12 wt. percent, alleviates the containment problem associated with employing a glass-forming oxide as a major constituent in the molten medium cracking process. Thus, it can be seen that the addition of a controlled amount of a glass-forming oxide to an alkali metal carbonate melt results in a molten medium exhibiting excellent coke dispersion properties without being extremely corrosive in nature, which properties are required for a commercial operation.

As stated above, the molten medium may contain other components such as ash constituents, metallic and nonmetallic oxides, sulfides, sulfates and various other salts in varying amounts so long as the medium is molten at the hydrocarbon conversion conditions of the instant invention, i.e., less than about 1000° F., and preferably from about 700° to less than about 1000° F., more preferably from about 700° to about 900° F., most preferably from about 740° to about 830° F., and provided that a sufficient amount of glass-forming oxide is employed to disperse by-product carbonaceous materials, i.e. coke. One skilled in the art will readily determine the applicable components as well as the stoichiometry of the glassforming oxides to said components which will be required in order to form the regenerable molten medium as described above. Further, various filler materials, catalysts or promoters may be added to the melt.

It is to be understood that although the molten medium of the instant invention is described throughout the specification in terms of an alkali metal carbonate and the glass-forming oxides, it is clearly within the scope of this invention to employ and define the molten medium of this invention with respect to the compounds, i.e., the salt formed when a glass-forming oxide is heated to the molten state in combination with the alkali metal carbonate or other alkali metal compound. For example, a molten medium consisting of an alkali metal carbonate ($M_2CO_3$) and boron oxide as the glass-forming oxide can also be expresssed in the molten state as a borate, on the basis of the following reaction:

$$B_2O_3 + M_2CO_3 \rightarrow M_2O{\cdot}B_2O_3 + CO_2$$

Accordingly, it is within the purview of the instant invention to employ as the molten medium of this invention an alkali metal carbonate and a glass-forming oxide, as defined above, in combination with an alkali metal or an alkali metal salt of the glass-forming oxide employed, e.g., alkali metal borate. It is to be noted that any of the melts of this invention may be prepared by fusing any combination of raw materials, which upon heating will form a glass-forming oxide either alone or in combination with an alkali metal reagent.

Individual regenerable molten media that are most preferred are those obtained when boron oxide is employed as the glass-forming oxide. The most preferred melt system of the instant invention comprises boron oxide in combination with a carbonate of lithium, sodium and mixtures thereof. The most preferred alkali metal carbonate reagent is a mixture of a major amount of sodium carbonate and a minor amount of lithium carbonate or a mixture of lithium carbonate, sodium carbonate and potassium carbonate.

In a process of this invention, a wide variety of feedstocks may be converted to produce predominantly liquid hydrocarbon products. In general, there is no limitation on the amount of sulfur and/or metals that may be present in said feedstocks. More specifically, the hydrocarbon feedstocks of the instant invention are heavy hydrocarbon feedstocks such as crude oils, heavy residua, atmospheric and vacuum residua, crude bottoms, pitch, asphalt, other heavy hydrocarbon pitch-forming residua, coal, coal tar or distillate, natural tars including mixtures thereof that contain from about 2 to about 6 wt. % sulfur. Such hydrocarbon feedstocks may be derived from petroleum, shale oil kerogen, tar sands bitumen processing, synthetic oils, coal hydrogenation, and the like. Preferably, at least a portion of the heavy hydrocarbon feedstocks boil above about 650° F. at atmospheric pressure. Most preferably, the hydrocarbon feedstocks that can be employed in the practice of the instant invention are crude oils, aromatic tars, atmospheric or vacuum residua containing materials boiling above about 650° F. at atmospheric pressure.

While not essential to the reaction, an inert diluent can be employed in order to regulate the hydrocarbon partial pressure in the molten media conversion zone. The inert diluent should normally by employed in a molar ratio from about 1 to about 50 moles of diluent per mole of hydrocarbon feedstock, and more preferably from about 1 to about 10 moles of diluent per mole of hydrocarbon feed. Illustrative, nonlimiting examples of the diluents that may be employed in the practice of the instant invention include helium, carbon dioxide, nitrogen, steam, methane, and the like.

The cracking operation may be conducted as a fixed bed process, i.e., where the feedstock vapors pass through a stationary bed containing the molten medium or, alternatively, the molten medium may be sprayed into a reactor or trickled down the reactor wall where the hydrocarbon feedstock passes through the reactor. The cracking operation may also be conducted in a batch or a continuous manner. If done continuously, the molten medium can flow either co-currently or countercurrently to the hydrocarbon flow.

As mentioned above, the conversion process of the instant invention results in the formation of predominantly liquid (at atmospheric pressure) hydrocarbon products. The conversion of the above-described heavy hydrocarbon feedstocks results in upgrading said feedstocks, by which is meant that a high percentage, i.e. above 50, and more preferably above 80 weight % of the material boiling above a temperature of 1050° F. (at atmospheric pressure) is converted to substantially lower boiling liquid hydrocarbon products. Such an unexpectedly high conversion to liquid hydrocarbon products by the practice of the instant invention is to be contrasted with the more conventional mild pyrolysis techniques for converting heavy hydrocarbon feedstocks such as visbreaking and hydrovisbreaking which normally result in below about 50 weight % conversions of materials boiling above about 1050° F.

Depending upon the temperature and the specific type of hydrocarbon feedstock, the weight ratio of hydrocarbon to molten medium in the reaction zone will vary in the range of from about 0.1/50 to about 50/0.1, preferably from about 0.5/5 to about 5/0.5 and more preferably from about 1/3 to about 3/1. In general, reaction is conducted at elevated pressures. The term "elevated pressures" refers to total pressures which may range from 500 to about 5000 psig, preferably from about 1000 to about 3000 psig, and more preferably from about 1500 to about 2500 psig. The reaction time is expressed in the amount of time the feedstock is in contact with the melt, i.e., residence time, and is desirably in the range of from about 0.001 to about 6 hours, and more preferably from about 0.1 to about 3 hours. It should be noted that in a continuous operation, the desired products are flashed overhead from the reaction zone so that the residence time will vary depending on the boiling range of each component so removed. The space velocity will range between about 0.1 and 5, preferably between about 0.2 and about 2, and more preferably between about 0.25 and about 1.25 W/W/hr. (weight of feed/weight of melt/hour).

In general, at least 500, preferably at least 1000, more preferably at least 1500 standard cubic feet of hydrogen per barrel of feed (SCF/B) will be present in the reaction zone. Preferably, the amount of hydrogen present will range from about 1000 to about 5000 SCF/B, more preferably from about 1200 to about 4000 and most preferably from about 1500 to about 3000 SCF/B based on hydrocarbon feedstock.

The hydrogen present in the reaction zone will be consumed during various reactions occurring therein, examples of which are the saturation of olefins and diolefins, saturation of some aromatics, reaction with sulfur and nitrogen compounds, saturation of various reactive species liberated by the cracking of large molecules, e.g. ethyl, methyl, benzyl, etc. free radicals. In general, the amount of hydrogen consumed in said reaction zone will be in the range of from about 100 to about 1800 SCF/B, preferably from about 400 to about 1200 SCF/B. Hydrogen partial pressures in the reaction zone will range between about 150 and about 4000 psig, preferably between about 200 and about 2000 psig.

As noted above, the hydrogen aids in removing sulfur and nitrogen from the feedstock, transferring most of same to the molten medium. In addition, the presence of hydrogen at the above conditions serves to suppress the formation of coke to an amount less than about 15 wt. %, preferably to an amount less than about 10 wt. % and more preferable to an amount less than about 5 wt. %. The hydrogen may be present in the form of a hydrogen-containing gas which may be obtained from any number of sources including commercially available pure hydrogen, naphtha reformers, hydrogen plants as well as the off gases from any hydrotreating process or hydrogen donor organic molecules such as tetralin, methylcyclohexane and the like. The term hydrotreating process is meant to include hydrofining, hydrocracking, hydrodesulfurization and the like or synthetic schemes in which hydrogen is a product. The hydrogen-containing gas may be pure or contain other gaseous materials such as light hydrocarbons ($C_1$–$C_{10}$), carbon monoxide, carbon dioxide, steam and the like. The hydrogen-containing gas may be introduced into the reaction zone alone or be mixed with the hydrocarbon feed prior to being introduced into said reaction zone. When the process is operated continuously, the hydrogen is preferably contacted with the hydrocarbon feed prior to contacting the molten medium.

It may be desirable, in some instances, such as for example, where the process feedstock contains a large amount of nitrogen and sulfur-containing constituents, to use a subsequent hydrotreating operation to further reduce the sulfur and nitrogen content of the effluent. The type of catalyst employed will be dependent, in part, on the characteristics of the product from the melt cracking operation. Thus, for example, a high sulfur product will require a sulfur-insensitive catalyst which has good desulfurization activity. The hydrotreating catalyst can be any commercially available hydrotreating catalyst used in the art such as, for example, a mixture comprising a major amount of an amorphous component and a minor amount of a hydrogenation component preferably comprising one or more transitional metals selected from Groups VIB and/or VIII of the Periodic Table and the oxides and sulfides thereof.

Representative of these metals are molybdenum, chromium, tungsten, nickel, cobalt, palladium, iron, rhodium, and the like, as well as combinations of these metals and/or their oxides and/or sulfides. Preferred metals are nickel, cobalt, molybdenum and mixtures thereof. One or more of the metals, metal oxides or sulfides, alone or in combination, may be added to the support in minor proportions ranging from 1 to 25 wt. % based on the total catalyst.

The amorphous component, i.e. support, can be one or more of a large number of non-crystalline materials having high porosity. The porous material is preferably inorganic but can be organic in nature if desired. Representative porous materials that can be employed include metals and metal alloys; sintered glass; firebrick, diatomaceous earth; inorganic refractory oxides; metal phosphates such as boron phosphate, calcium phosphate and zirconium phosphate; metal sulfides such as iron sulfide and nickel sulfide; inorganic oxide gels and the like. Preferred inorganic oxide support materials include one or more oxides of metals selected from Groups IIA, IIIA and IV of the Periodic Table. Non-limiting examples of such oxides include aluminum oxide, titania, zirconia, magnesium oxide, silicon oxide, titanium oxide, silica-stabilized alumina and the like.

The catalysts may be prepared by any of the general methods described in the art such as by cogelation of all the components, by impregnation of the support with salts of the desired components, by deposition, by mechanical admixture and the like. The catalyst is preferably pre-sulfided by conventional methods such as by treatment with hydrogen sulfide or carbon disulfide prior to use.

Temperatures in the separate hydrotreating zone will range from about 400°–900° F., preferably from about 500°–800° F. Pressures will range from about 100 to 5000 psig, preferably from about 200 to 2500 psig and flow rate will vary from about 0.5 to 5, preferably 0.3 to 2.0 V/V/Hr. The total hydrogen supply rate (makeup and recycle hydrogen) is 200–20,000 s.c.f. of hydrogen per barrel of feedstock, preferably 300 to 5,000 s.c.f. The hydrotreating operation results in substantially no conversion of hydrocarbons to lower molecular weight materials. Thus, the overall yield of product from the hydrotreater is greater than about 99 LV%.

The liquid products derived from the present invention may be suitably separated by distillation into components boiling predominantly in the lubricating oil range, e.g. between about 650° to 1050° F. (at atmospheric pressure). The 650° to 1050° F. fraction may undergo further upgrading operations such as solvent-extraction or dewaxing and may be used subsequent to the cracking (and optional hydrotreating) operation to improve the lube oil quality, if so desired. These processes are well known in the art and will, therefore, not be further discussed. See, for example, U.S. Pats. 1,860,823 and 2,052,196 in connection with phenol treating, U.S. Pat. 1,962,103 in connection with furfural treating and U.S. Pat. 3,105,809 in connection with solvent dewaxing, the disclosures of which are incorporated herein by reference. The 1050° F.$^+$ fraction contains extremely high boiling asphaltic components which substantially inhibit upgrading from the operations mentioned above. However, the yield of the 650° to 1050° F. fraction may be maximized by recycling the 1050° F.$^+$ fraction to the molten medium and vacuum distilling the resultant product therefrom. The thus treated 1050° F.$^+$ material can be effectively subjected to the additional processing indicated above if desired.

After the hydrocarbon feedstock has been converted in the molten medium at the desired temperature and pressure, the hydrocarbon effluent from the reaction zone is cooled to condense and separate liquid products from the gaseous products containing light paraffins. The significant advantage of the instant invention is that the presence of hydrogen suppresses the formation of carbonaceous materials during the conversion process. Although the exact mechanism for suppressing the formation of said carbonaceous materials is not fully known, much of the observed improvement is believed due to "capping" of free radicals, i.e., saturation of reactive moieties formed during the cracking of large molecules. The carbonaceous materials thus formed, however, are readily suspended in the molten medium and can subsequently be gasified by contacting the melt with a gasifying reagent such as a gaseous stream containing free or combined oxygen, i.e., air, steam, carbon dioxide and mixtures thereof, at elevated temperatures and pressures in order to rapidly regenerate the stable molten medium. The carbonaceous materials that are formed during the thermal cracking reaction in the presence of hydrogen may be generally described as solid particle-like materials having a high carbon content such as those materials normally formed during high temperature pyrolysis of organic compounds.

The term "gasification" as used herein describes the contacting of the carbonaceous materials in the molten medium with a reagent containing elemental or chemically combined oxygen such as air, steam, carbon dioxide, and mixtures thereof. The gasification reaction is carried out at temperatures in the range of from above about the melting point of the molten medium up to about 2000° F. or higher and at a total pressure in the range of from atmospheric to about 1500 p.s.i.g. More preferably, the temperature at which the gasification reaction is carried out is in the range of from about 1000° to about 1800° F. and at a total pressure in the range of from about atmospheric to about 1300 psig, preferably from about 100 to about 1000 psig, and more preferably from about 200 to about 600 psig.

Normally, the amount of oxygen which must be present in the gaseous stream containing free or combined oxygen in order to effectuate the gasification of the carbonaceous materials is in the range of from about 1 to about 100 wt. % oxygen, and more preferably from about 10 to about 25 wt. % oxygen. Normally, the gaseous stream containing oxygen is passed through the melt at a rate of from less than about 0.01 w./w./hr. to about 100 w./w./hr. More preferably, the rate at which the gaseous stream is passed through the melt system of the instant invention is in the range of from about 0.01 w./w./hr. to about 10 w./w./hr. Preferably air is employed as the gaseous stream containing oxygen in order to effect a rapid regeneration of the molten medium.

Steam or carbon dioxide, either alone or in admixture with oxygen may also be employed to gasify the carbonaceous materials present in the molten medium of the instant invention. However, as is appreciated in the art, the different gasification reagents mentioned above will each gasify the carbonaceous material at different rates. Generally, the presence of free elemental oxygen in the melt will result in higher gasification rates than with other reagents such as steam or $CO_2$. Thus, when steam or $CO_2$ is employed as the gasification reagent, more severe conditions, e.g., higher temperatures and longer residence time, will be required in order to achieve gasification rates equivalent to or higher than when, for example, air or oxygen is employed as the gasification reagent.

The specific gasification rate of the carbonaceous materials in individual regenerable molten media, as defined by the amount of carbonaceous material which is gasified per hour per cubic foot of melt, is dependent upon the temperature at which the gasification process is carried out, as well as the residence time of the oxygen containing gas or steam in the melt, the concentration of carbonaceous material in the melt, and feed rate of oxygen containing gas into the media. As a general rule, the carbon gasification rate increases as the temperature of the melt, concentrations of carbonaceous materials and feed rate of the oxygen-containing gas increase. Preferably, the concentration of carbonaceous materials in the molten medium is maintained in the range of from about 0.1 to about 20 weight %, preferably 1.0 to 5.0 wt. % and most preferably from about 1.0 to 3.0 wt. %, in order to effect a rapid gasification thereof. Accordingly, it can be seen that it is advantageous to carry out the gasification reaction process at temperatures above about 1000° F., and more preferably in the range of from 1000° to 1800° F. and at an oxygen gas feed rate of 0.01 to 10 w./w./hr. in the presence of from about 1.0 to about 10 wt. % carbonaceous materials in order to effectuate a rapid gasification of the carbonaceous materials present in the melt. Such a rapid gasification will necessarily result in a rapid regeneration of the melt.

The process of this invention will be further described with reference to the accompanying drawing which shows one embodiment of the present invention. It is to be understood that the drawing is shown only in such detail as is necessary for a clear understanding of the invention and that no intention is made thereby to unduly limit the scope of this invention. Various items such as valves, compressors, instrumentation, as well as other process equipment and control means have been omitted therefrom for the sake of simplicity. Variations obvious to those having ordinary skill in the art of hydrocarbon cracking processes are included within the broad scope of the present invention.

Referring now to the figure, a heavy hydrocarbon residuum fraction in line 19, preferably having an initial boiling point (at atmospheric pressure) above about 650° F., is contacted with hydrogen in line **1*b* prior to being introduced to cracking zone 2 via feed line 1. Within the cracking zone is maintained a molten bed 3 containing an oxide of boron and an alkali metal carbonate reagent comprising a major amount of sodium carbonate in combination with a minor amount of lithium carbonate. The hydrocarbon feedstock may be passed upwardly through melt 3 by introducing the feedstock at a point below the upper level of the molten media. Means should be provided to secure intimate contacting of the feed with the melt. The temperature of the molten medium 3** is maintained below about 1000° F. A total hydrogen partial pressure ranging between about 200 and about 2,000 psig is maintained in the zone.

After a portion of the hydrocarbon feedstock has been at least partially reduced to lighter products through contact with the hot molten medium 3, the resulting cracked products and hydrogen pass overhead from cracking zone 2 via line 4. The cracked products may be cooled by indirect heat exchange or through contact with a quench medium introduced via line 5. If desired, the cracked products and hydrogen may be passed directly to a fractionation facility via line 6.

In the cracking operation, a minor portion of the hydrocarbon feedstock is converted to coke materials. The instant melt compositions suspend to the coke by-product within the melt. The coke materials are removed from the melt by a gasification step involving contacting the coke containing melt with an oxidizing gas. In the process of the present invention, the molten medium that contains suspended carbonaceous material and the liquid hydrocarbon products are withdrawn from cracking zone 2 by way of line 7 and introduced to separation zone 8. The specific gravity of the molten medium and the liquid products is in the range of from about 1.7 to about 2.3 and from about 0.8 to about 1.3, respectively. The most suitable equipment for performing said separation may be selected by one skilled in the art from commercially available equipment as described in, but not limited to, Section 21 of the Fourth Edition of the "Chemical Engineers' Handbook" edited by John H. Perry (1963). The liquid hydrocarbon products thus separated in zone 8 are removed therefrom and sent to a fractionation facility via line 9. The molten medium containing suspended carbonaceous material is withdrawn from separation zone 8 via line 10 and introduced into gasification zone 11. Within gasification zone 11, the coke-containing molten medium 12 is contacted with a reagent introduced into the gasification zone 11 via line 13. Preferably the reagent is elemental oxygen (or a gas stream containing elemental oxygen), steam or carbon dioxide. During contact with the gasifying reagent, the temperature within the gasification zone may be brought to about 2000° F. and the total pressure to about 500 psig.

During gasification, all or preferably a portion of the coke or carbonaceous material contained in the melt is combusted, the gasification products being carried overhead via line 14. The chemical composition of the overhead gaseous effluent is dependent on the type of gasifying reagent employed. When oxygen or an oxygen-containing gas is employed, only a minor proportion of the total gaseous effluent is made up of sulfur-bearing materials. This result is believed to be achieved because the sulfur oxides formed during gasification react with a portion of the alkali metal carbonate constituents of the melt to form metal sulfites or sulfates. Upon recycle of the gasified melt to the cracking zone via line 15, the inorganic sulfur-bearing materials are believed to be reduced to the corresponding sulfides due to the renewed presence of carbonaceous material in the melt. Preferably, a vapor lift is used to circulate the melt between the cracking zone and the gasification zone. When steam is used as the gasifying reagent at moderate temperatures, the sulfur impurities contained in the melt within the gasification zone 11 are not converted to sulfur oxides and are not absorbed or reacted with the melt constituents but, rather, are converted to hydrogen sulfide which passes overhead via line 14.

During continued use the initial charge of melt material will become contaminated with larger and larger amounts of sulfur and ash-forming impurities. It is preferred that the total sulfur concentration in the molten medium be maintained below about 5.0 wt. %, preferably between about 0.25 to 2.0 wt. %, based on total molten medium. Accordingly, to maintain the melt at the desired sulfur level and/or to diminish ash concentrations, a portion of the contaminated melt must be withdrawn periodically from the system and replaced with fresh melt or, alternatively, reconditioned and returned to the system. One technique for reconditioning the contaminated melt is depicted in the figure. Specifically, a minor quantity of contaminated melt material is withdrawn periodically (as indicated by the broken line) from line 15 and passed via line 16 to a sulfur recovery zone 17 wherein it is contacted with carbon dioxide and steam that are introduced via line 18. Typically, the melt 19 contained within zone 17 is treated with the carbon dioxide/steam reagents at temperatures in the range of from about 800° to 1800° F. Provided that the bulk of the sulfur contaminants present in the melt are in the form of sulfides, contacting with the steam/carbon dioxide mixture will convert the sulfide ion to hydrogen sulfide which is removed from the treating zone via line 20. If the bulk of the sulfur sent to zone 17 is not in a metal sulfide form, it is necessary, for maximum sulfur removal, to reduce the sulfur present in the melt to a sulfide form in a reducing zone located prior to zone 17.

After treatment in zone 17, the molten medium having a reduced sulfur content is withdrawn via line 21 and returned to the system via line 22. A portion of the treated effluent in line 22 may be withdrawn periodically from the system via line 23 for treatment for the removal of metallic, e.g., V, Ni, Fe, constituents. This is accomplished in metal recovery zone 24 by introducing water via line 5 into said zone 24 and dissolving the molten medium having a reduced sulfur content in line 23. The vanadium, nickel and iron components are then precipitated as oxides, hydroxides or mixtures thereof in a water solution. The precipitate is separated by filtration and the metals withdrawn by line 26. The water is evaporated leaving a residue having a reduced sulfur content which is remelted and recycled to the cracking zone 2 via line 27. Alternately, a portion of the contaminated melt material may be withdrawn from line 16 and sent directly to metal recovery zone 24.

The following examples are presented to illustrate the process of the present invention and are not intended to unduly restrict the limits of the claims appended hereto.

EXAMPLE 1 (Runs A–F)

A series of tests were conducted to demonstrate the advantage of alkali carbonate melts containing boron oxide when used in the presence of hydrogen at elevated pressures. The initial alkaline reagent portion of the boron-containing melt was composed of about 43 mole % lithium carbonate, 31 mole % sodium carbonate, and 26 mole % potassium carbonate. Sufficient boron oxide was added to the melt to bring the molar ratio of alkali carbonates to boron oxide to about 6:1 (10 wt. % $B_2O_3$ on total melt). The carbonates/boron oxide mixture was heated in a graphite-lined reactor to a temperature ranging from about 1200° to about 1300° F. over a period of from 1–2 hours until a homogeneoous melt was secured. Thereafter the melt (melting point of about 740° F.) was solidified by cooling a portion thereof being introduced into a 1-gallon reactor (in Runs D, E. and F the reactor was graphite-lined) equipped with an anchor-type stirrer and means for introducing feedstock and means for withdrawing liquid and gaseous product materials. A means for introducing the hydrogen gas under pressure was also provided.

In each test run, a feedstock comprising a heavy Arabian (Safaniya) vacuum residual material having an initial boiling point of about 980° F. was introduced into a batch reaction zone which was maintained at the temperatures, pressures and hydrogen treat gas rates indicated in Table I. The weight ratio of feedstock to molten medium ranged from about 0.57 to about 1.4. The feedstock exhibited an API gravity of 5.0°, a viscosity of 200,000 centistokes (c.s.) at 140° F., a Conradson carbon residue number (CCR) of 22 wt. % and contained about 0.5 wt. % nitrogen, 5.1 wt. % sulfur, a hydrogen to carbon atomic ratio of 1.43 and 342 ppm total metals (Ni, V, Fe). The feedstock and hydrogen were introduced into the reactor and brought into intimate contact with the stirred melt. Liquid and gaseous products remained within the reactor while said reactor cooled. Samples of gas were taken and analyzed using a gas chromatograph. The liquid hydrocarbon feedstock was decanted and fractionated in vacuum for subsequent analysis.

EXAMPLE 2 (Runs G–K)

Another series of tests were conducted using the feedstock of Example 1 in a spent molten medium wherein the weight ratio of feedstock to molten medium ranged from about 0.66 to about 2.0. In Runs G–J, the spent molten medium was simulated by adding organic complexes of acetyl acetone (specifically acetyl acetonates) to the fresh molten medium to yield a spent molten medium having metal contents (after reduction with hydrogen at 900° F.) of 2.1 wt. % vanadium, 0.4 wt. % nickel, and 1.0 wt. % iron based on the molten medium. It should be pointed out that unless the metals are in true solution and not merely dispersed in the melt, there is no guarantee that metals deposited by thermal deposition of acetyl acetonates are in the same physical state of dispersion as metals deposited by thermal cleavage of metalloporphyrins in a heavy crude. In Run K, the spent molten medium was simulated by adding 5 wt. % sulfur to the fresh molten medium as $Na_2S \cdot 9H_2O$, followed by dehydration. The reaction zone in each run was maintained at the conditions set forth in Table I.

The results of the tests are shown in Table I.

TABLE I

| Run | A | B | C | D | E | F | G | H | I | J | K |
|---|---|---|---|---|---|---|---|---|---|---|---|
| Added Metals (V/Ni/Fe), Wt. % | Fresh Molten Medium | | | | | | 2.1/0.4/1.0 | | | | |
| Added Sulfur, Wt. % | — | — | — | — | — | — | — | — | — | — | 5 |
| Reaction Zone Conditions | | | | | | | | | | | |
| Feed/melt wt. ratio | 0.88 | 1 | 1.4 | 0.66 | 0.66 | 0.57 | 0.66 | 0.66 | 0.76 | 2 | 1 |
| Temperature, °F. | 765 | 785 | 820 | 795 | 800 | 770 | 775 | 800 | 825 | 790 | 800 |
| Total pressure, psig | 1000 | 1200 | 1500 | 2000 | 2200 | 2500 | 2500 | 2300 | 2500 | 2500 | 2300 |
| Hydrogen Treat, SCF/B | 960 | 670 | 500 | 1400 | 1730 | 2000 | 2200 | 1800 | 1800 | 2350 | 2400 |
| Hydrogen Consumption SCF/B | 180 | 620 | — | 1030 | — | 1200 (1) | 600 | 850 | 325 | 400 | 1000 |
| LHSV wt.feed/wt.melt/hr. | 2 | 2 | 2 | 1.6 | 1 | 0.33 | 0.33 | 0.33 | 0.33 | 1 | 0.33 |
| Steam, Wt.% of feed | — | — | — | — | — | — | — | 5 | 5 | — | — |
| Product Yield, Wt.% of Feed | | | | | | | | | | | |
| Total $C_5^+$ Liquid | 95.1 | 85.9 | 68.4 | 85 | 75 | 79 | 94 | 91 | 75 | 87 | 88 |
| Coke | 1.0 | 7.7 | 22 | 3.5 | 6 | 1.5 | trace | 1.7 | 16 | 6 | 5 |
| Gas ($C_1/C_4$ by Diff.) | 3.8 | 5.7 | 7.5 | 10.5 | 17 | 17.5 | 4 | 5.5 | 7 | 5 | 7.5 |
| $H_2S + NH_3$ | 0.3 | 1.3 | 2.5 | 1.5 | 2 | 2 | 2 | 2 | 2 | 1.5 | 1.5 |
| $C_5$/1050°F. Liquid | 38 | 59 | 68 | 53 | 58 | 53 | 52 | 75 | 70 | 72 | 75 |
| Conversion of 1050°F. +, % (2) | 35 | 62 | 76 | 59 | 74 | 68 | 51 | 80 | 73 | 76 | 79 |
| Product Quality of Total $C_5^+$ Liquid | | | | | | | | | | | |
| Gravity °API | 6.8 | 19.1 | 32.1 | 15.2 | 22 | 20 | 15 | 24 | 30.7 | 26.2 | 23 |
| Conradson Carbon Residue Wt.% | 16.5 | 14.0 | 8.5 | 12.5 | 12 | 11 | 12.5 | 14 | 7.5 | 15 | 12 |
| Sulfur, wt. % | 4.8 | 4.0 | 3.0 | 3.6 | 3.0 | 3.0 | 3.1 | 3.1 | 2.8 | 3.6 | 3.4 |
| Nitrogen, wt. % | 0.54 | 0.29 | 0.13 | 0.34 | 0.3 | 0.3 | — | 0.3 | 0.25 | 0.27 | — |
| Demetallized, % | 52 | 78 | 99+ | 83 | 96 | 90 | 70 | 95 | 99+ | 90 | 83 |
| Viscosity at 140°F., C.S. | 859 | 15 | <5 | — | — | — | — | — | — | — | — |
| Carbon, wt.% (3) | 85 | 84.8 | 88.5 | 85.3 | 86 | 86.3 | 86.0 | 85.5 | 84.8 | 85.6 | 85.7 |
| Hydrogen, wt.% (3) | 9.9 | 10.7 | 11.2 | 10.9 | 10.6 | 10.9 | 11.1 | 11.4 | 11.3 | 11.4 | 11.3 |
| H/C Atomic Ratio | 1.40 | 1.49 | 1.57 | 1.54 | 1.49 | 1.52 | 1.55 | 1.59 | 1.60 | 1.59 | 1.58 |

(1) Uncertain reading due to inclusion of low boiling hydrocarbon in gas product yield.
(2) Defined as the amount of 1050− material in the total product (gas, liquid, coke) minus the amount of 1050− material in the original feed, the difference being divided by the amount of 1050+ material in the feed multiplied by 100.
(3) Amount in feed and products measured by combustion techniques.

A comparison of Runs A–C with D–E indicate that the higher hydrogen gas rates favor improved $C_5^+$ liquid yield and suppress the formation of coke. In addition, a comparison of Runs A–F with Runs G–K indicates that the yield of $C_5^+$ liquid is greater when using the spent molten medium. In particular, Runs F and G show that at similar operating conditions, the system with dissolved metals gives only 51% conversion of 1050° F.$^+$ material (versus 68% for the fresh molten medium) and a higher yield of $C_5^+$ liquid product. Similarly a comparison of Runs E with J and F with G, which were obtained at similar operating conditions, shows that the activity of the molten medium is moderated by the presence of contaminants in the feed (e.g. metals and sulfur compounds) so as to reduce gas make and coke formation, thereby increasing the liquid yield.

A comparison of runs based on similar demetallization levels (e.g. Runs C with I, D with K, E with H, and F with J) shows that the demetallized $C_5^+$ liquid yield is higher when using the spent medium. Again, this difference is due to less gas formation with the simulated spent molten medium.

What is claimed is:

1. A process for converting a heavy hydrocarbon feedstock at least a portion of which boils above about 650° F. at atmospheric pressure to lighter hydrocarbon materials which comprises contacting said feedstock in the presence of hydrogen with a regenerable alkali metal carbonate molten medium containing from 0.1 to 25 weight percent, calculated as oxide and based on total molten medium, of a glass-forming oxide selected from the group consisting of oxides of boron, phosphorus, vanadium, silicon, tungsten and molybdenum, and thereby suppressing the formation of carbonaceous materials, at a temperature in the range of from about the melting point of said medium to less than about 1000° F. and at elevated pressures for a time sufficient to form lighter hydrocarbon materials and carbonaceous materials, said carbonaceous materials being suspended uniformly throughout the molten medium.

2. The process of claim 1 wherein the temperature of the molten mediium is maintained in the range of from about 700° to less than about 1000° F.

3. The process of claim 2 wherein said glass-forming oxide is an oxide of boron.

4. The process of claim 2 wherein said alkali metal carbonate is a mixture of sodium carbonate and lithium carbonate or a mixture of sodium carbonate, lithium carbonate and potassium carbonate.

5. The process of claim 4 wherein said glass-forming oxide is an oxide of boron.

6. The process of claim 1 wherein said molten medium is regenerated after contact with said hydrocarbon feedstock by contacting said molten medium with oxygen, steam, carbon dioxide and mixtures thereof at a temperature in the range of from above about the melting point of said medium to about 2000° F.

7. The process of claim 1 wherein the hydrogen is present in an amount of at least 500 SCF/B based on hydrocarbon feedstock.

8. The process of claim 1 wherein carbonaceous materials are formed in an amount less than about 15 wt. %.

9. A process for cracking a heavy hydrocarbon feedstock comprising a component selected from the group consisting of crude oils and residua containing from about 2 to 6 wt. % sulfur to lighter hydrocarbon materials which comprises contacting said heavy hydrocarbon feedstock in the presence of hydrogen in an amount of at least 500 SCF/B based on hydrocarbon feedstock with a regenerable alkali metal carbonate molten medium containing from 0.1 to 25 wt. %, calculated as oxide and based on total molten medium, of a glass-forming oxide selected from the group consisting of oxide of boron, phosphorus, vanadium, silicon, tungsten, and molybdenum, and thereby suppressing the formation of carbonaceous materials, at a temperature in the range of from about the melting point of the molten medium to less than about 1000° F. and a total pressure of from about 1000 to about 3000 psig to form predominantly liquid hydrocarbon products and carbonaceous materials, said carbonaceous materials being suspended uniformly in the molten medium, and thereafter gasifying at least a portion of said carbonaceous materials formed during said conversion process by contacting said molten medium containing said carbonaceous materials with oxygen, carbon dioxide, steam or mixtures thereof at a temperature in the range of from about the melting point of said molten medium to about 2000° F.

10. The process of claim 9 wherein the temperature of the molten medium during contact with heavy hydrocarbon feedstock is maintained in the range of from about 700° to about 900° F.

11. The process of claim 9 wherein at least a portion of said heavy hydrocarbon feedstock boils above about 650° F. at atmospheric pressure.

12. The process of claim 9 wherein said glass-forming oxide is an oxide of boron.

13. The process of claim 9 wherein said alkali metal carbonate is a mixture of sodium carbonate and lithium carbonate or a mixture of sodium carbonate, lithium carbonate and potassium carbonate.

14. The process of claim 9 wherein said carbonaceous materials are formed in an amount less than about 10 wt. %.

15. The process of claim 14 wherein hydrogen is present in an amount of at least 1000 SCF/B based on hydrocarbon feedstock.

16. The process of claim 9 wherein said molten medium is regenerated at a temperature in the range of from about 1000° F. to about 1800° F.

17. The process of claim 9 wherein said molten medium contains from about 1–20 wt. %, calculated as oxide and based on total molten medium, of an oxide of boron.

18. The process of claim 17 wherein said carbonaceous materials are contacted with a gas stream containing from about 10 to about 25 wt. % oxygen.

19. The process of claim 18 wherein said gas stream is air.

20. The process of claim 17 wherein said carbonaceous materials are contacted with steam.

21. A process for cracking a heavy hydrocarbon feedstock comprising a component selected from the group consisting of crude oils and residua that contains 2 to 6 wt. % sulfur and at least a portion of which boils above about 650° F. at atmospheric pressure to lighter hydrocarbon materials which comprises contacting said feedstock in the presence of hydrogen in an amount of at least 1000 SCF/B based on hydrocarbon feedstock with a regenerable alkali metal carbonate molten medium comprising a mixture of lithium and sodium carbonates containing from 1 to 20 wt. %, calculated as oxide and based upon the total molten medium, of an oxide of boron, and thereby suppressing the formation of carbonaceous materials, at a temperature in the range of from about the melting point of the molten medium to less than about 900° F. and a total pressure of from about 1500 to about 2500 psig, to form predominantly liquid hydrocarbon products and carbonaceous materials, at least a portion of said carbonaceous materials formed in said conversion being dispersed uniformly in said molten medium in amounts varying from about 1.0 to 5.0 wt. %, based on total molten medium, and thereafter gasifying at least a portion of said carbonaceous materials in said molten medium by contacting the same with an oxygen-containing gas at a temperature in the range of from above about the melting point of said molten medium to about 2000° F.

22. The process of claim 21 wherein said carbonaceous materials are formed in an amount less than about 5 wt. %.

23. The process of claim 22 wherein hydrogen is present in an amount of at least 1500 SCF/B based on hydrocarbon feedstock.

24. The process of claim 21 wherein hydrogen is present in an amount ranging from about 1500 to about 3000 SCF/B based on hydrocarbon feedstock.

25. The process of claim 21 wherein the temperature ranges from about 740° to about 830° F.

26. The process of claim 21 wherein the light hydrocarbon materials contain a substantial amount of lube oil components.

* * * * *